US009770617B2

(12) United States Patent
von Hoffmann et al.

(10) Patent No.: US 9,770,617 B2
(45) Date of Patent: Sep. 26, 2017

(54) LOW PROFILE PASSIVE EXERCISE GARMENT

(71) Applicant: Tau Orthopedics, LLC, Coto de Caza, CA (US)

(72) Inventors: Kaitlin von Hoffmann, Sunnyvale, CA (US); Gerard von Hoffmann, Coto de Caza, CA (US)

(73) Assignee: Tau Orthopedics, LLC, Coto de Caza, CA (US)

( * ) Notice: Subject to any disclaimer, the term of this patent is extended or adjusted under 35 U.S.C. 154(b) by 132 days.

(21) Appl. No.: 14/667,629

(22) Filed: Mar. 24, 2015

(65) Prior Publication Data

US 2015/0258360 A1 Sep. 17, 2015

Related U.S. Application Data

(63) Continuation of application No. 12/951,947, filed on Nov. 22, 2010, now Pat. No. 8,986,177, which is a (Continued)

(51) Int. Cl.
*A63B 21/02* (2006.01)
*A63B 21/055* (2006.01)
(Continued)

(52) U.S. Cl.
CPC ..... *A63B 21/0557* (2013.01); *A63B 21/4011* (2015.10); *A63B 21/4017* (2015.10); *A63B 21/4039* (2015.10); *A63B 23/0494* (2013.01); *A63B 24/0062* (2013.01); *A63B 21/0083* (2013.01); *A63B 21/0087* (2013.01);
(Continued)

(58) Field of Classification Search
USPC ..... 482/1–148
See application file for complete search history.

(56) References Cited

U.S. PATENT DOCUMENTS 2,664,566 A 1/1954 Mianulli
2,832,334 A 4/1958 Whitelaw
(Continued)

FOREIGN PATENT DOCUMENTS

WO 2014138504 A1 9/2014
WO 2014153201 A1 9/2014
WO 2014194257 12/2014

OTHER PUBLICATIONS

Written Opinion Issued on PCT Application Serial No. PCT/US16/23715 by ISA/US dated Aug. 11, 2016, pp. 1-6.
(Continued)

*Primary Examiner* — Stephen R Crow
(74) *Attorney, Agent, or Firm* — Gerald von Hoffman; Aurora Consulting LLC

(57) ABSTRACT

Disclosed is a muscle specific exercise device. The device may provide passive or active resistance training throughout an angular range of motion. The device may be low profile, and worn by a wearer, such as beneath conventional clothing. Exercise of selective joints or motion of the body may thereby be accomplished throughout the wearer's normal daily activities, without the need for access to conventional exercise equipment. Alternatively, the device may be worn as a supplemental training tool during conventional training techniques.

7 Claims, 9 Drawing Sheets

Related U.S. Application Data continuation-in-part of application No. 12/797,718, filed on Jun. 10, 2010, now abandoned.

(60) Provisional application No. 61/218,607, filed on Jun. 19, 2009.

(51) Int. Cl.

| | |
|---|---|
| ***A63B 23/04*** | (2006.01) |
| ***A63B 24/00*** | (2006.01) |
| ***A63B 21/00*** | (2006.01) |
| *A63B 21/008* | (2006.01) |
| *A63B 23/02* | (2006.01) |
| *A63B 23/12* | (2006.01) |

(52) U.S. Cl.

CPC ..... *A63B 21/023* (2013.01); *A63B 21/0552* (2013.01); *A63B 23/02* (2013.01); *A63B 23/1281* (2013.01); *A63B 2208/14* (2013.01); *A63B 2209/10* (2013.01); *A63B 2220/16* (2013.01); *A63B 2220/34* (2013.01); *A63B 2220/51* (2013.01)

(56) References Cited

U.S. PATENT DOCUMENTS

| | | | | |
|---|---|---|---|---|
| 4,065,814 | A | 1/1978 | Fox | |
| 4,485,808 | A | 12/1984 | Hepburn | |
| 4,621,620 | A | 11/1986 | Anderson | |
| 4,657,000 | A | 4/1987 | Hepburn | |
| 4,829,989 | A | 5/1989 | Deamer | |
| 4,875,677 | A | 10/1989 | Tetreault | |
| 4,910,802 | A | 3/1990 | Malloy | |
| 4,947,835 | A | 8/1990 | Hepburn et al. | |
| 5,052,379 | A | 10/1991 | Airy et al. | |
| 5,176,600 | A | 1/1993 | Wilkinson | |
| 5,201,074 | A | 4/1993 | Dicker | |
| 5,263,923 | A | 11/1993 | Fujimoto | |
| 5,306,222 | A | 4/1994 | Wilkinson | |
| 5,308,305 | A | 5/1994 | Romney | |
| 5,337,737 | A | 8/1994 | Rubin et al. | |
| 5,399,154 | A | 3/1995 | Kipnis et al. | |
| 5,465,428 | A | 11/1995 | Earl | |
| 5,472,412 | A | 12/1995 | Knoth | |
| 5,527,244 | A | 6/1996 | Waller et al. | |
| 5,553,322 | A | 9/1996 | Cebo-Johnson | |
| 5,606,745 | A * | 3/1997 | Gray | A41D 13/0015 2/227 |
| 5,662,595 | A | 9/1997 | Chesher et al. | |
| 5,685,811 | A | 11/1997 | McShane et al. | |
| 5,720,042 | A | 2/1998 | Wilkinson | |
| 5,749,840 | A | 5/1998 | Mitchell et al. | |
| 5,788,618 | A | 8/1998 | Joutras | |
| 5,792,034 | A | 8/1998 | Kozlovsky | |
| RE35,940 | E | 10/1998 | Heinz et al. | |
| 5,842,959 | A | 12/1998 | Wilkinson | |
| 5,867,827 | A | 2/1999 | Wilkinson | |
| 5,875,491 | A | 3/1999 | Wilkinson | |
| 5,937,441 | A | 8/1999 | Raines | |
| 5,960,474 | A | 10/1999 | Dicker et al. | |
| 5,976,063 | A | 11/1999 | Joutras et al. | |
| 5,978,966 | A | 11/1999 | Dicker et al. | |
| 5,993,362 | A | 11/1999 | Ghobadi | |
| 6,039,677 | A | 3/2000 | Spletzer | |
| 6,129,638 | A | 10/2000 | Davis | |
| 6,176,816 | B1 | 1/2001 | Dicker et al. | |
| 6,186,970 | B1 | 2/2001 | Fujii et al. | |
| 6,210,354 | B1 | 4/2001 | Ousdal | |
| 6,231,488 | B1 | 5/2001 | Dicker et al. | |
| 6,314,580 | B1 | 11/2001 | Greenberg et al. | |
| 6,397,496 | B1 | 6/2002 | Seymour | |
| 6,409,693 | B1 | 6/2002 | Brannigan | |
| 6,440,094 | B1 | 8/2002 | Maas | |
| 6,656,097 | B2 | 12/2003 | Karecki | |
| 6,666,801 | B1 | 12/2003 | Michalow | |
| 6,757,916 | B2 | 7/2004 | Mah et al. | |
| 6,834,752 | B2 | 12/2004 | Irby et al. | |
| 6,872,187 | B1 | 3/2005 | Stark et al. | |
| 6,954,968 | B1 | 10/2005 | Sitbon | |
| 7,048,098 | B1 | 5/2006 | Moradian | |
| 7,087,003 | B1 | 8/2006 | Katterjohn | |
| 7,153,246 | B2 | 12/2006 | Koscielny et al. | |
| 7,235,038 | B2 | 6/2007 | Liao | |
| 7,599,806 | B2 | 10/2009 | Hauschildt | |
| 7,608,026 | B1 | 10/2009 | Nicassio | |
| 7,652,386 | B2 | 1/2010 | Donelan et al. | |
| 7,659,636 | B2 | 2/2010 | Donelan et al. | |
| 7,682,322 | B2 | 3/2010 | Engelman | |
| 7,744,511 | B2 | 6/2010 | Grigoriev et al. | |
| 7,758,481 | B2 | 7/2010 | Drennan et al. | |
| 7,845,023 | B2 | 12/2010 | Swatee | |
| 7,849,518 | B2 | 12/2010 | Moore et al. | |
| 7,861,319 | B2 | 1/2011 | Torry | |
| 7,874,970 | B2 | 1/2011 | Glisan | |
| 7,931,571 | B2 | 4/2011 | Bernardoni | |
| 7,931,609 | B2 | 4/2011 | Blanchard | |
| 8,043,243 | B2 | 10/2011 | Nathanson et al. | |
| 8,060,945 | B2 | 11/2011 | Adarraga | |
| 8,063,644 | B2 | 11/2011 | Rezvani et al. | |
| 8,171,570 | B2 | 5/2012 | Adarraga | |
| 8,273,001 | B2 * | 9/2012 | Karecki | A63B 21/4025 2/22 |
| 8,312,646 | B2 | 11/2012 | Meschter et al. | |
| 8,409,117 | B2 | 4/2013 | Cheng et al. | |
| 8,544,114 | B2 | 10/2013 | Williams et al. | |
| 8,555,415 | B2 | 10/2013 | Bradstreet et al. | |
| 8,663,133 | B2 | 3/2014 | Johnson et al. | |
| 8,663,142 | B1 | 3/2014 | Pansiera | |
| 8,707,463 | B2 * | 4/2014 | Orloff | A41D 13/0015 2/22 |
| 8,762,077 | B2 | 6/2014 | Redmond et al. | |
| 8,784,350 | B2 | 7/2014 | Cohen | |
| 8,870,798 | B2 | 10/2014 | Coleman | |
| 8,939,924 | B1 | 1/2015 | Paulos | |
| 8,951,136 | B1 | 2/2015 | Booher | |
| 8,986,177 | B2 * | 3/2015 | von Hoffmann | A63B 23/0494 482/124 |
| 9,192,806 | B2 | 11/2015 | Mial | |
| 9,204,811 | B2 | 12/2015 | Wright | |
| 9,327,156 | B2 * | 5/2016 | von Hoffmann | A63B 21/02 |
| 9,375,603 | B2 | 6/2016 | Matsuura et al. | |
| 2004/0040064 | A1 | 3/2004 | Mah et al. | |
| 2004/0116260 | A1 | 6/2004 | Drennan et al. | |
| 2005/0101887 | A1 | 5/2005 | Stark et al. | |
| 2005/0148915 | A1 | 7/2005 | Nathanson et al. | |
| 2005/0239602 | A1 | 10/2005 | Cordova et al. | |
| 2005/0255975 | A1 | 11/2005 | Horn | |
| 2005/0261113 | A1 * | 11/2005 | Wilkinson | A63B 21/0004 482/124 |
| 2005/0275416 | A1 | 12/2005 | Hervieux et al. | |
| 2006/0000478 | A1 | 1/2006 | Taylor et al. | |
| 2006/0016649 | A1 | 1/2006 | Gordaninejad et al. | |
| 2006/0046910 | A1 | 3/2006 | Rastegar et al. | |
| 2006/0046913 | A1 | 3/2006 | Squittieri | |
| 2006/0079825 | A1 | 4/2006 | Hilton et al. | |
| 2006/0096818 | A1 | 5/2006 | Moradian | |
| 2006/0272071 | A1 | 12/2006 | Mickle et al. | |
| 2006/0287621 | A1 | 12/2006 | Atkinson et al. | |
| 2007/0010772 | A1 | 1/2007 | Ryan | |
| 2007/0016120 | A1 | 1/2007 | Latronica et al. | |
| 2007/0032359 | A1 | 2/2007 | Toronto | |
| 2007/0100265 | A1 | 5/2007 | Gamada | |
| 2007/0123997 | A1 | 5/2007 | Herr et al. | |
| 2007/0135279 | A1 | 6/2007 | Purdy et al. | |
| 2007/0219074 | A1 | 9/2007 | Pride | |
| 2007/0245835 | A1 | 10/2007 | Hauschildt | |
| 2008/0009771 | A1 | 1/2008 | Perry et al. | |
| 2008/0026917 | A1 | 1/2008 | Campana | |
| 2008/0108918 | A1 | 5/2008 | Joutras et al. | |
| 2008/0218310 | A1 | 9/2008 | Alten et al. | |
| 2008/0222769 | A1 | 9/2008 | Natonson | |
| 2009/0253325 | A1 | 10/2009 | Brookstein et al. | |
| 2009/0281394 | A1 | 11/2009 | Russell et al. | |

(56) References Cited

U.S. PATENT DOCUMENTS

2010/0029224 A1 2/2010 Urushihara et al.
2010/0041527 A1 2/2010 Miller
2010/0075557 A1 3/2010 Shteiyer
2010/0077527 A1 4/2010 Lee et al.
2010/0144490 A1 6/2010 Purdy et al.
2010/0193304 A1 8/2010 Böse et al.
2010/0223717 A1 9/2010 Foy et al.
2010/0248915 A1 9/2010 Gibson-Horn
2010/0267525 A1 10/2010 Tanner
2010/0323859 A1 12/2010 von Hoffmann
2011/0010001 A1 1/2011 Chung et al.
2011/0111932 A1 5/2011 von Hoffmann et al.
2011/0126335 A1 6/2011 Schultz
2011/0224585 A1 9/2011 Hall
2011/0231986 A1 9/2011 Waldie et al.
2011/0247127 A1* 10/2011 Pou ..... A41D 13/0012 2/227
2011/0266323 A1 11/2011 Kazerooni et al.
2012/0094811 A1 4/2012 Karecki
2012/0116258 A1 5/2012 Lee
2012/0136231 A1 5/2012 Markel
2012/0225755 A1 9/2012 Lloyd
2012/0259255 A1 10/2012 Tomlinson et al.
2013/0040783 A1 2/2013 Duda et al.
2013/0085040 A1* 4/2013 Bowers ..... A63B 21/0552 482/8
2013/0130874 A1 5/2013 Richardson et al.
2013/0150218 A1 6/2013 Mial
2013/0190147 A1 7/2013 Luo et al.
2013/0207889 A1 8/2013 Chang et al.
2013/0247330 A1 9/2013 Daul et al.
2013/0298301 A1 11/2013 Petrakis et al.
2013/0338472 A1 12/2013 Marcia Barber et al.
2014/0109282 A1 4/2014 White et al.
2014/0173934 A1 6/2014 Bell
2014/0200121 A1 7/2014 von Hoffmann et al.
2014/0207030 A1 7/2014 Hall
2014/0222943 A1 8/2014 Oleson et al.
2014/0238153 A1 8/2014 Wood et al.
2014/0265677 A1 9/2014 Orand
2014/0278125 A1 9/2014 Balakrishnan et al.
2014/0278229 A1 9/2014 Hong et al.
2014/0296761 A1 10/2014 Yamamoto et al.
2014/0313049 A1 10/2014 Doherty
2014/0336020 A1 11/2014 von Hoffmann et al.
2014/0358053 A1 12/2014 Triolo et al.
2014/0364771 A1 12/2014 Pitts et al.
2014/0379275 A1 12/2014 Yuen et al.
2015/0031970 A1 1/2015 Lain
2015/0045703 A1 2/2015 Strausser et al.
2015/0057128 A1 2/2015 Ishii
2015/0148619 A1 5/2015 Berg et al.
2015/0190669 A1 7/2015 Matsuura et al.
2015/0230719 A1 8/2015 Berg et al.
2015/0258360 A1 9/2015 von Hoffmann et al.
2016/0038783 A1 2/2016 Matsuura et al.
2016/0062333 A1 3/2016 Jayaraman
2016/0107309 A1 4/2016 Walsh et al.
2016/0128632 A1 5/2016 Wiebe et al.

OTHER PUBLICATIONS

International Search Report Issued on PCT Application Serial No. PCT/US16/23715 by ISA/US dated Aug. 11, 2016 pp. 1-4.

* cited by examiner

LOW PROFILE PASSIVE EXERCISE GARMENT

CROSS-REFERENCE TO RELATED APPLICATIONS

This application is a continuation of U.S. patent application Ser. No. 12/951,947, filed on Nov. 22, 2010, issued as U.S. Pat. No. 8,986,177 on Mar. 24, 2015, which is a continuation-in-part of U.S. patent application Ser. No. 12/797,718, filed Jun. 10, 2010, which claims the benefit of U.S. Provisional Application No. 61/218,607, filed Jun. 19, 2009, the entirety of these applications are hereby incorporated by reference herein.

BACKGROUND OF THE INVENTION

Resistance training, sometimes known as weight training or strength training, is a specialized method of conditioning designed to increase muscle strength, muscle endurance, and muscle power. Resistance training refers to the use of any one or a combination of training methods which may include resistance machines, dumbells, barbells, body weight, and rubber tubing.

The goal of resistance training, according to the American Sports Medicine Institute (ASMI), is to "gradually and progressively overload the musculoskeletal system so it gets stronger." This is accomplished by exerting effort against a specific opposing force generated by elastic resistance (i.e. resistance to being stretched or bent). Exercises are isotonic if a body part is moving against the force. Exercises are isometric if a body part is holding still against the force. Resistance exercise is used to develop the strength and size of skeletal muscles. Full range of motion is important in resistance training because muscle overload occurs only at the specific joint angles where the muscle is worked. Properly performed, resistance training can provide significant functional benefits and improvement in overall health and well-being.

Research shows that regular resistance training will strengthen and tone muscles and increase bone mass. Resistance training should not be confused with weightlifting, power lifting or bodybuilding, which are competitive sports involving different types of strength training with non-elastic forces such as gravity (weight training or plyometrics) an immovable resistance (isometrics, usually the body's own muscles or a structural feature such as a door frame).

Whether or not increased strength is an objective, repetitive resistance training can also be utilized to elevate aerobic metabolism, for the purpose of weight loss.

Resistance exercise equipment has therefore developed into a popular tool used for conditioning, strength training, muscle building, and weight loss. Various types of resistance exercise equipment are known, such as free weights, exercise machines, and resistance exercise bands or tubing. Various limitations exist with the prior art exercise devices. For example, many types of exercise equipment, such as free weights and most exercise machines, are not portable. With respect to exercise bands and tubing, they may need to be attached to a stationary object, such as a closed door or a heavy piece of furniture, and require sufficient space. This becomes a problem when, for example, the user wishes to perform resistance exercises in a location where such stationary objects or sufficient space are not readily found. Resistance bands are also limited to a single resistance profile in which the amount of resistance changes as a function of angular displacement of the joint under load.

A need therefore exists for resistance exercise equipment that is portable, that may be used on its own without the need to employ other types of equipment, and that allows for adjustable resistance modes and levels.

SUMMARY OF THE INVENTION

There is provided in accordance with one aspect of the present invention, a method of elevating aerobic metabolism. The method comprises the steps of attaching a garment to a wearer, the garment having a first attachment structure for attachment at the waist, a second attachment structure for attachment to the leg above the knee, and a third attachment structure for attachment to the leg below the knee. The first, second and third attachment structures may be discrete zones on a unitary garment.

The garment additionally comprises a first resistance element between the first and second attachment structures, and a second resistance element between the second and third attachment structures. The resistance elements may comprise any of a variety of elements for providing resistance against movement, such as elastic materials, springs, bendable elements, or articulating joints.

The wearer then wears the garment while moving through a normal range of motion, in opposition to resistance from the garment.

In accordance with another aspect of the present invention, there is provided a passive exercise device. The exercise device comprises a garment, having a waist portion and a left and right leg portion. A left resistance element is operatively secured to the left leg portion, and a right resistance element is operatively secured to the right leg portion. Each of the right resistance elements imposes a resistance to movement of at least about 2 ft lbs.

In certain embodiments, the exercise device imposes a resistance against extension in the amount of between about 2 and about 75 ft lbs., such as at least about 2, 5, 7.5, 10 and 25 ft. lbs. In certain embodiments, the exercise device imposes a resistance against flexion within the range of from about 1 to about 50 ft. lbs, such as at least about 2, 5, 7.5, 10 or 15 ft. lbs.

In certain embodiments, the passive exercise device imposes a level of resistance to extension which is at least 50% higher and in some implementations at least 100% higher than the resistance against flexion.

The passive exercise device may additionally include a release, for disengaging a resistance element in response to a sudden movement by the wearer.

In accordance with another aspect of the present invention, there is provided a low profile, passive exercise device, configured to elevate aerobic metabolic activity compared to a baseline aerobic metabolic activity in the absence of the device, through a range of normal movement between a first region of the body and a second region of the body. The passive exercise device comprises a first attachment structure for attachment with respect to a first region of the body. A second attachment structure is provided, for attachment with respect to a second region of the body which is movable throughout an angular range with respect to the first region. A flex zone is provided between the first and second attachment structures, and the flex zone imparts uni-directional or bi-directional resistance to movement between the first and second regions of the body, throughout a range of motion, in an amount of at least about 1 ft lb.

In one implementation of the invention, the first attachment structure comprises a structure for attachment to the leg above the knee. The first attachment structure may be configured for attachment at the waist. In one implementation of the invention, the flex zone comprises a malleable material, such as a copper rod.

The first attachment structure and second attachment structure may comprise first and second regions of a garment. The garment may extend at least from the waist to below the knee, and, in some applications of the invention, from the waist to the ankle. The garment may impose a first level of resistance to movement across the hip, and a second, lower level of resistance across the knee.

Further features and advantages of the present invention will become apparent to those of skill in the art in view of the detailed description of preferred embodiments which follows, when considered together with attached drawings and claims.

DETAILED DESCRIPTION OF THE PREFERRED EMBODIMENT

Detailed descriptions of the preferred embodiments are provided herein. It is to be understood, however, that the present invention may be embodied in various other forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
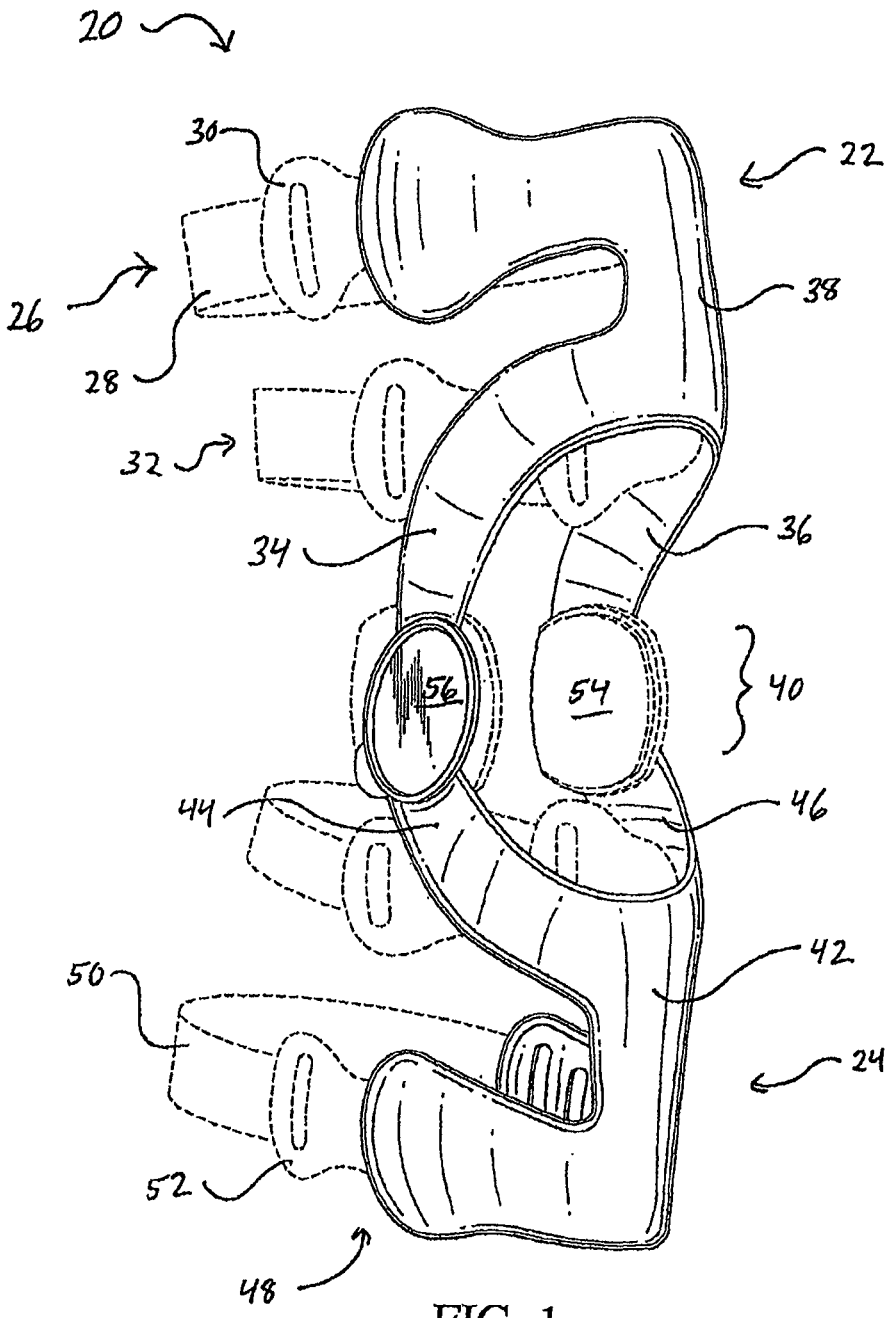
FIG. 1 is an anterior lateral schematic view of an exercise assembly in accordance with the present invention, configured for positioning about the knee.
Figure 5:
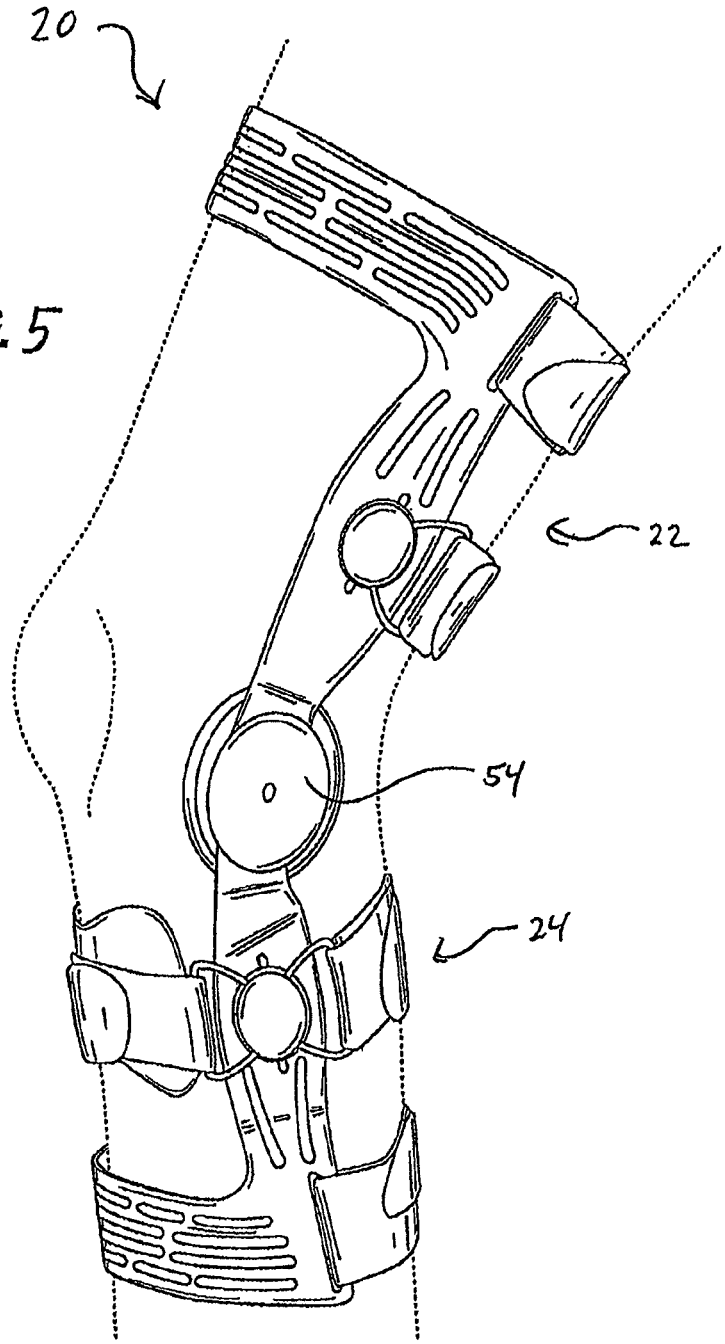
FIG. 5 is a lateral view of an exercise assembly in accordance with the present invention.
Figure 6:
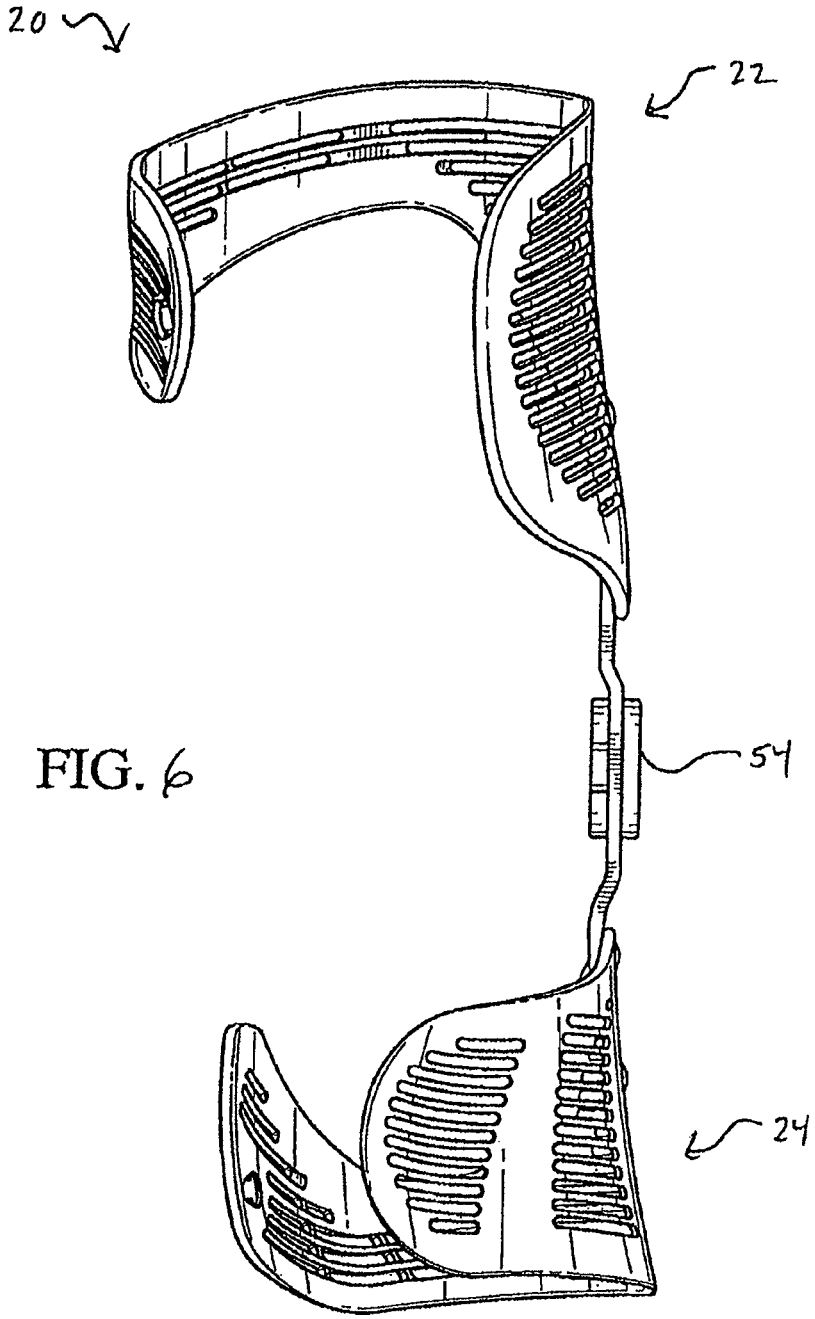
FIG. 6 is a posterior view of an alternate exercise assembly of the present invention.

Referring now to FIG. 1 there is disclosed a perspective view of a quadriceps/hamstring version of an exercise apparatus in accordance with the present invention. FIGS. 1, 5 and 6 show an embodiment of an apparatus that is designed to exercise the quadriceps and hamstring muscles, however, as will be described below, other versions of exercise apparatus are contemplated for exercising other muscles, muscle pairs or groups such as biceps/triceps, thoraco-lumbar/abdominal, chest/back, latissimus dorsi/pectorals and others that may benefit from a common bidirectional resistance muscle training system for multiple groups of muscles.

The knee joint is a uni-axial hinge joint. The knee moves in a flexion (bending of the knee) and extension (straightening of the knee) direction. The three major bones that form the knee joint are: the femur (thigh bone), the tibia (shin bone), and the patella (kneecap). The prime muscle movers of the knee joint are the quadriceps muscles (on top of the femur), which move the knee into extension; and the hamstring muscles (underneath the femur), which move the knee into flexion. The quadriceps muscles are made up of five muscles known as the rectus femoris, vastus lateralis, vastus medialis, vastus intermedius and a secondary muscle, the vastus medialis oblique (VMO). The hamstring is made up of three muscles known as the biceps femoris, semimembranosus, and semitendinosus. The hamstring to quadriceps muscle strength ratio is two-thirds; meaning, the hamstring is normally approximately thirty-three percent weaker than the quadriceps. The muscles, ligaments, nervous system, and skeletal system work in unison to stabilize the knee during gait activities (walking, running, jumping).

In general, the devices in accordance with the present invention are designed to provide resistance to motion between a first region and a second region of the body such as across a simple or complex joint, throughout an angular range of motion. The resistance can be either unidirectional, to isolate a single muscle or muscle group, or bidirectional to exercise opposing muscles or muscle groups. Optimally, the device will be user adjustable to select uni or bidirectional resistance.

In the example of a knee brace, configured to train quadriceps, the device imposes resistance to extension of the lower leg at the knee joint and throughout the angular range of motion for the knee. During flexion (movement in the return direction) the device may be passive without providing any resistance to movement. Alternatively, in a bidirectional device, the device imposes resistance throughout both extension and flexion in this example to train both the quadriceps and the hamstring muscles. The resistance to flexion and extension may be equal, or may be dissimilar, depending upon the objective of the exercise.

The devices in accordance with the present invention may also be provided with a user adjustable load or resistance.

In one implementation of a unidirectional device, the device is biased in a first direction, to load movement in a second, opposite direction. Bias may be provided by any of a variety of springs, elastic bands or other structures which exert a force opposite to the direction of motion. At any point throughout the angular range of motion except a single end point, the user must exert force against the device, whether the subject joint is stationary or in motion. This is distinct from the passive device, which exerts no force in the absence of motion.

In an alternate implementation, the device provides passive resistance to motion. At rest, the device imposes no bias, but the device imposes a resistance to motion in either one or both directions.

In one mode of operation, the device is worn over an extended period of time wherein the activities of the wearer are dominantly aerobic as distinguished from anaerobic (i.e. dominantly non-anaerobic). The invention may be practiced where some of the activities are of an aerobic nature, but in order to optimize certain benefits from the invention a higher degree of aerobic activities would be done. The extended period of time could be as short as one hour or less but is preferably at least two hours and sometimes at least eight hours, although it could also be at least about four hours or six hours or more.

Aerobic activity means that all of the metabolic oxygen requirements of the active tissues of the body are being fully met by the oxygen supply transported in the blood at that time. Activity levels that stay within these requirements are classified as aerobic and last beyond 5-7 minutes of continuous, rhythmic exercise. The principal fuels are fat and sugar, and the predominant by-products are $CO_2$, $H_2O$, heat and large quantities of adenosine triphosphate (ATP).

Anaerobic activity means that the metabolic oxygen requirements of the active tissues of the body exceed the oxygen supply being transported in the blood at that time. Any aerobic activity can become an anaerobic activity if the intensity of the exercise becomes increasingly harder so that the oxygen requirement of the active body tissues begins to exceed the blood's oxygen supply. High intensity activities that can only be sustained for periods of time less than 5-7 minutes fit the anaerobic classification. The principal fuel for anaerobic activity is sugar, and the predominant byproduct is lactic acid.

Metabolically, people are never perfectly aerobic, or perfectly anaerobic. Instead, the body functions more dominantly in one condition than the other based on the intensity or the duration of the activity in which the body is engaged. Thus, even though the total distance is the same, a swimmer will provoke an entirely different metabolic response by swimming 10×100 yards hard on a 1:30 interval than by swimming an easy 1,000 yards straight.

During aerobic activity, the muscular demand for oxygen is always less than or equal to the supply of oxygen being delivered by the body's circulatory system. The subject is able to work comfortably for long periods of time without experiencing undue respiratory distress, muscular discomfort, or muscular failure. The primary fuel sources for maintaining this aerobic condition are fat (triglyceride) and sugar (carbohydrate/glucose/glycogen).

During low exertion level conditions, the consumption ratio is roughly ⅔ fat and ⅓ carbohydrate with a trace of protein. Both provide the necessary ATP (potential high-energy molecule) that the muscles use for their contraction process. As long as the oxygen supply to the active tissue is equal to or greater than the metabolic requirement, glucose molecules are actively transported into the muscle via insulin while the free fatty acid (FFA) molecules freely cross the cell membranes. Sugar (glycogen) previously stored in the muscle cells is added to the potential fuel supply.

Once inside the cell, cellular enzymes dismantle the molecules into carbon, hydrogen, and oxygen. The oxygen and carbon combine to form $CO_2$ which is returned to the lungs via the blood stream for us to exhale. The remaining hydrogen ions are shuttled by active transporters called NAD and FAD into the small energy-producing organelles called mitochondria. The hydrogen and oxygen combine to form $H_2O$ which we eliminate through sweating, breathing, our intestines and bladder. The heat produced during the enzyme activity maintains our body core temperature and elevates it during exercise. Large quantities of the high energy ATP are produced to sustain prolonged, continuous muscular activity.

As the intensity of muscular activity increases, the oxygen requirement increases; body core temperature elevates; the brain signals the adrenal medullas to secrete epinephrine (adrenaline); blood delivers the epinephrine throughout the body; the epinephrine stimulates the Beta-receptors of fat cells (adipocytes) by triggering internal adipocyte lipase to dismantle the stored triglyceride into FFA's and glycerol. The muscles use the FFA's as previously described, and the liver catabolizes the glycerol and reduces it to $H_2O$ and heat, both of which we eliminate.

Thus, extended easy to moderate training is a better way to burn fat, and, as discussed below, high intensity exercise is a better way to build burst strength. The elite athlete can not optimize their training regimen unless they know the crossover point. This can be evaluated, for example, by monitoring blood for the appearance of elevated lactic acid which signals the conversion to anaerobic activity. Both improve strength.

Aerobic activities include sleeping, sitting, and exercise activities that produce heart rates that are about 85% or less of one's estimated maximum rate. Roughly estimated, this is 170-160 bpm for healthy people 20-30 years old; 153-145 for healthy people 30-50 years old, and above age 50 it may be in the range of about 140-128. Above about 85%, the body's demand for oxygen beings to overtake the blood's oxygen supply, and a person begins the transition into anaerobic dominance. The change-over can be easily documented using laboratory metabolic analyzer systems, but this is not always practical. The simplest method is to monitor one's own breathing process during exercise. If it's easy to speak to someone while exercising, then one is dominantly aerobic. If one has to use a halting speech pattern due to the need for frequent breaths, then one is in transition. If getting a breath of air is more important than speaking, then one is dominantly anaerobic.

Activities that last less than about 10 seconds do not produce lactic acid, and they do not utilize glycogen (sugar stored in the muscle). ATP that has been previous produced by aerobic and anaerobic activity and has been stored in the muscle is used for such short-burst activities. Examples include blinking one's eye, twitching a finger, exploding out of starting blocks in a track event, sprinting 35 yds (i.e., football drills), or possibly up to a 25 yard sprint for an elite, in condition swimmer.

During the short burst activity ATP is split by an enzyme to release the potential energy in the compound. Within microseconds upward to about 30 seconds, ADP and the separated terminal phosphate are re-united by creatine phosphate to re-create another ATP molecule to be used again. The liberated energy is used for muscular contraction and resynthesis of ATP.

High intensity muscular activity exceeding about 10 seconds requires more oxygen than the blood can supply to the active muscle tissues. This hypoxic (insufficient oxygen) condition activates an enzyme in the muscle cell which interrupts the aerobic sugar and fat metabolism pathway. One molecule of stored muscle sugar (glycogen) and one molecule of the blood sugar (glucose) entering the cell are converted to two molecules of pyruvic acid. Pyruvic acid is reduced into lactic acid. Minimal amounts of ATP are produced.

This snowball effect quickly increases the lactate concentration, further increasing the anaerobic enzyme activity to produce more lactate. Lactic acid spilling over into the blood stream is circulated to fat cells and impairs the stimulation of fat cell lipase by the circulating adrenaline. Fat cell triglyceride is not released into the blood stream which deprives the muscle cells of a supply of fat for their aerobic use. The reduction in available fat shuts down the aerobic activity of the ATP-producing muscle mitochondria. Increasing the exercise intensity, depriving the muscle mitochondria of fat and oxygen, increasing the lactic acid concentration all stimulate the increased activity of the anaerobic enzyme activity. The process is a cycle that feeds itself until there is not enough ATP to continue driving the muscle. The result is muscle fatigue and failure.

Heart rates exceeding about 90% of one's estimated, age-adjusted maximum typically accompany anaerobic metabolism dominance.

Even during this type of high-intensity work, we are still not perfectly anaerobic. While muscles in one part of the body are working aerobically, others are working anaerobically. When the preponderance of muscle tissue is working anaerobically, the ratio of sugar and fat use switches to ¼ fat and ¾ sugar rather than the ⅔ fat and ⅓ carbohydrate consumed at lower exertion levels.

The present invention is intended primarily for use to build strength under conditions which favor aerobic metabolism, which, in view of the foregoing will as a necessary consequence be accompanied by an elevated consumption of body fat. Thus the present invention may also comprise methods of achieving weight loss, by wearing one or two or more passive resistance devices for an extended period of time (disclosed elsewhere herein) each day for at least two or three or four or five or more days per week. The present invention also contemplates methods of reducing percent body fat via the same method steps.

In one embodiment, there is provided a knee support assembly with an upper leg attachment and a lower leg attachment. The two attachments are coupled together by interior (medial) and exterior (lateral) joint assemblies. These joint assemblies may comprise simple, uniaxial pivots, bicentric pivots, or more complex mechanisms which seek to mimic true joint motion. Additionally, other embodiments of the joint support assembly include abutting features that limit the angular range of movement of the upper attachment relative to the lower attachment in flexion, extension, or both flexion and extension. The device may alternatively span the hip, with a waist band attachment such as a wide adjustable belt linked to a right and left leg attachment across a left and right flex zone which each imparts resistance to movement of the hip. A three attachment zone construct may be provided which includes a waist attachment, a first and second thigh attachment and a first and second calf attachment, to provide resistance to both hip and knee movement. This may take the form of an article of clothing such as a compression garment with stretch panels, stiffening slats or flex structures disclosed elsewhere herein carried by the compression garment.

Exercise devices in accordance with the present invention also include a force modifying apparatus that interconnects, in the knee example, the upper and lower leg attachments. This force modifying apparatus can be a damper mechanism which provides a force which opposes flexion of the joint, extension of the joint, or both flexion and extension. In some embodiments this opposing' force is a function of the angular velocity of the upper leg attachment relative to the lower leg attachment. In yet other embodiments the opposing force is also, or alternatively, a function of the angular displacement of the upper leg attachment relative to the lower leg attachment. In still other embodiments the opposing force is also, or alternatively, a function of the history of the angular velocity and/or the angular position of the upper leg attachment relative to the lower leg attachment.

In some embodiments the force modifying apparatus is a fluid damper, such as a hydraulic or pneumatic damper. In one embodiment, the force modifying apparatus is a hydraulic shock absorber whose resistance is a function of direction, velocity, and manual adjustment setting. In some embodiments the fluid damper is a linear device, such as with a piston and rod that extend out from a cylinder. In yet other embodiments the fluid damper is of the rotary type. An example of a rotary damper can be found in U.S. Pat. No. 7,048,098 to Moradian, and also in U.S. Patent Application Publication No. 2006/0096818 A1 (to Moradian).

Yet other embodiments of the present invention include a joint support assembly which includes an electronic data logger. In some embodiments, this data logger records electrical signals which are related to the load being transmitted by the force modifying apparatus, the angular position of the upper leg attachment relative to the lower leg attachment, and/or the angular velocity of the upper leg attachment relative to the lower leg attachment.

Various dimensions and materials are described herein. It is understood that such information is by example only, and is not limiting to the inventions.

FIG. 1 shows an anterior-lateral elevational view of a passive exercise assembly 20 for a human knee. However, the present invention is not limited to exercising human knees, and can be used with other joints, such as human elbow joints and elsewhere as described above. Further, the devices and methods described herein are not limited to humans, but can also be applied to limbs of other animals.

The passive exercise assembly 20 comprises an upper leg attachment 22, movably associated with a lower leg attachment 24. The upper leg attachment 22 comprises at least a first connector 26 for releasable connection above the knee, to the leg of a wearer. First connector 26 may comprise any of a variety of structures, such as a strap 28 having a releasable clip or buckle 30 as is understood in the art. Any of a variety of snaps, buckles, Velcro, or other connectors may be utilized. An additional connector 32 may be provided, depending upon the desired performance characteristics.

The first connector 26 may be carried by at least a first proximal strut 34 and preferably a second proximal strut 36, which extend between a proximal support 38 and a flex zone 40. The structural components of the exercise assembly 20, including the proximal support 38, first proximal strut 34 and second proximal strut 36 may be constructed from any of a variety of materials which provide sufficient rigidity for the intended purpose. For example, molded polymeric material such as high density polyethylene, nylon, PEEK, PEBAX, and others may be utilized. Alternatively, lightweight metal, such as aluminum, magnesium or nickel-titanium alloys may be utilized, as well as composites including carbon fiber assemblies. Optimal embodiments of the present invention will include relatively high strength, low profile construction, such that the passive resistance exercise devices of the present invention may be worn comfortably beneath normal street clothing, without detection.

The lower leg attachment 24 may be approximately symmetrical about the flex zone 40 with the upper leg attachment 22, except that it will generally be smaller in scale due to the normal difference in size between the quadriceps and the calf. In general, lower leg attachment 24 will comprise a distal support 42 separated from flex zone 40 by a first distal strut 44 and, preferably, a second distal strut 46. At least a second connector 48 is provided, for releasable connection to the wearer's leg, at a point below the knee. Second connector 48 may comprise a strap 50 with a releasable buckle 52 or other releasable connection device. As will be apparent to those of skill in the art, the foregoing structure is adapted for positioning the flex zone 40 in the vicinity of the wearer's joint, in this instance a knee. The upper leg attachment 22 is adapted for connection about the quadricep, and the lower leg attachment 24 is adapted for connection about the calf.

The flex zone 40 comprises at least a first dynamic joint 54, and, preferably, a second dynamic joint 56. The dynamic joints 54 and 56 will generally although not necessarily be symmetrical about the wearer's joint, and only a single dynamic joint will be described in greater detail below. It will be understood, however, that the description of the single dynamic joint applies equally to both.

The dynamic joint 54 permits the exercise assembly 20 to pivot or flex about an axis or a zone, to allow normal angular movement of the knee or other joint or flexible aspect of anatomy to be exercised. In one embodiment, the first dynamic joint 54 and second dynamic joint 56 are each pivotable about an axis which extends transversely to the longitudinal axis of the straightened leg. However, as described elsewhere herein, true anatomical movement of the leg throughout its angular range of motion is more complex than a single pivot point motion, and the first dynamic joint 54 and second dynamic joint 56 may be more complex structures which permit shifting of the axis of rotation at various points throughout the angular range of motion.

The dynamic joint 54 includes at least one resistance element to impose resistance to angular movement of the lower leg attachment 24 with respect to the upper leg attachment 22. The resistance may be in both extension and flexion directions, or may be 0 in extension, above 0 in flexion, or 0 in flexion and above 0 upon extension. Alternatively, the dynamic joint 54 may impose resistance to motion in both the flexion and extension directions, however at a different level of resistance.

The angular range of motion permitted by the dynamic joint 54 may be within the range of from about 0° (straight leg) to about 145° or more. Typically, an angular range of motion between about 0 and about 45 or 55° is sufficient for a joint such as the knee.

In bi-directional exercise device, the first dynamic joint 54 preferably provides resistance to movement in both the flexion and extension directions. However, the level of resistance may differ. For example, in a normal knee, the ratio of the natural strength of a hamstring to a quadricep is roughly 1:3. A balanced passive resistance device may therefore impose 1 lb. of resistance on flexion for every 3 lbs. of resistance on extension. However, for certain athletic competitions or other objectives, the wearer may desire to alter the basic strength ratio of the unexercised hamstring to quadricep. So for example, the passive exercise device 20 may be provided with a 2 lb. resistance on flexion for every 3 lb. resistance on extension or other ratio as may be desired depending upon the intended result.

In any of the embodiments disclosed herein, whether mechanical braces, fabric garments or hybrids, the resistance to movement will be relatively low compared to conventional weight training in view of the intended use of the apparatus for hours at a time. Anaerobic metabolism may be elevated by repetitively placing a minor load on routine movement over an extended period. The load will generally be higher than loads placed by normal clothing and technical wear, and preselected to work particular muscle groups. Preferably, the resistance elements may be adjusted or interchanged with other elements having a different resistance, or additive so that adding multiple resistance elements can increase the net resistance in a particular resistance zone.

The specific levels of resistance will vary from muscle group to muscle group, and typically also between flexion and extension across the same muscle group. Also wearer to wearer customization can be accomplished, to accommodate different training objectives. In general, resistances of at least about 0.5, and often at least about 1 or 2 or 3 or more foot-pounds will be used in most applications on both flexion and extension. Devices specifically configured for rehabilitation following injury may have lower threshold values as desired. Across the hip or knee, resistance against extension in healthy patients will often be within the range of from about 2 to about 75 foot-pounds, more commonly within the range of from about 2 to about 25 foot-pounds, such as at least about 5, 7.5, 10 or 15 foot-pounds. Resistance against flexion will typically be less, such as within the range of from about 1 to about 50 foot-pounds, and often within the range of from about 2 to about 25 foot-pounds. Values of at least about 5, 7.5 or 10 foot pounds may be appropriate depending upon the wearer's objectives. The resistance to extension might be at least about 130%, sometimes at least about 150% and in some embodiments at least about 200% of the resistance to the corresponding flexion.

The resistance imposed upon either flexion, extension, or both may be preset by the manufacturer, or may be adjustable by the wearer. As will be discussed in greater detail below, adjustability may be accomplished by either adjustment of a single dynamic joint 54 such as throughout a continuous or stepped range, or by replacement of a component of the dynamic joint 54 by a replacement component having a different resistance characteristic.

Figure 2:
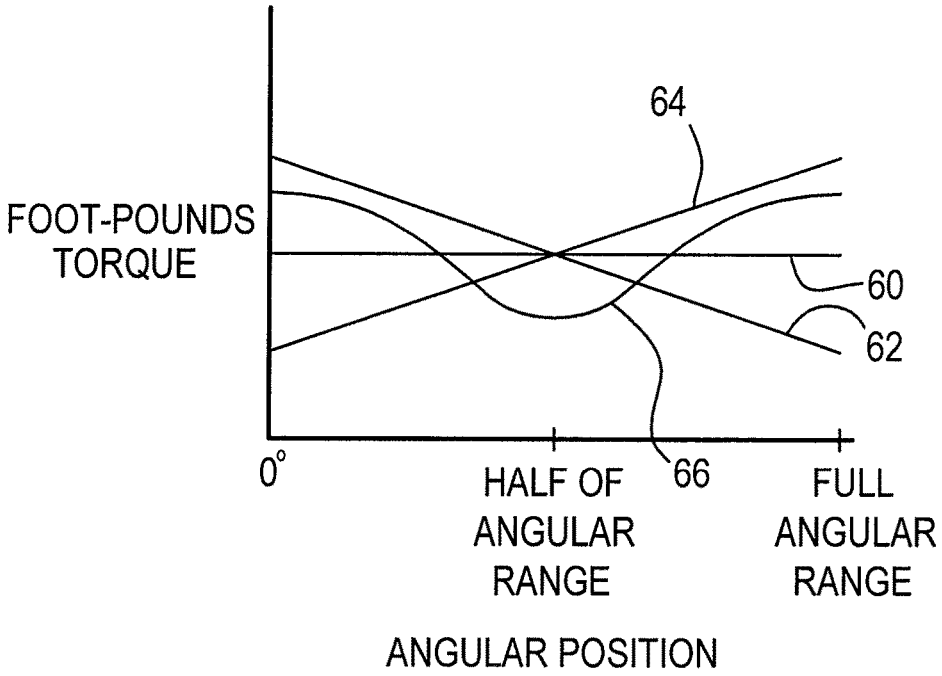
FIG. 2 is a plot of different resistance profiles as a function of angular rotation of a joint, which may be accomplished by the exercise assemblies of the present invention.

The dynamic joint 54 may impart any of a variety of resistance profiles, as a function of angular displacement of the joint. For example, FIG. 2 schematically and qualitatively illustrates the pounds of resistance to movement in either or both an extension or flexion direction, as a function of the angular deviation of the joint across a dynamic motion range. In this illustration, an angle of zero may represent a limb in a "start" or straight configuration, while the midpoint of the range of motion is half way through the range of motion of the target join or motion segment. The maximum range of motion is the maximum normal range for the target joint.

Referring to plot 60, there is illustrated an example of the dynamic joint 54 in which the resistance to movement is constant throughout the angular range of motion, as a function of angle. Thus, at whatever point the distal extremity may be throughout the angular range of motion with respect to the adjacent joint, incremental motion encounters the same resistance as it would at any other point throughout the angular range of motion.

Alternatively, referring to plot 62, there is illustrated the force curve relating to a dynamic joint 54 in which the resistance to motion is greatest at the beginning of deviation from linear, and the resistance to motion falls off to a minimum as the distal extremity reaches the limit of its angular range.

Referring to plot 64, the dynamic joint 54 imposes the least resistance at the beginning of bending the limb from linear, and the force opposing motion increases as a function of angular deviation throughout the range of motion. This may be utilized, for example, to emphasize building strength on the back half or back portion of an angular range of motion.

As a further alternative, referring to plot 66, the dynamic joint 54 may be configured to produce the most strength at the end points of the range of motion, while deemphasizing a central portion of the range of motion. Although not illustrated, the inverse of the plot 66 may additionally be provided, such that the end points in either direction of the angular range of motion across a joint are deemphasized, and strength throughout the middle portion of the range of motion is emphasized.

As will be apparent to those of skill in the art, any of a variety of resistance profiles may be readily constructed, depending upon the desired objective of the training for a particular athlete.

Figure 3:
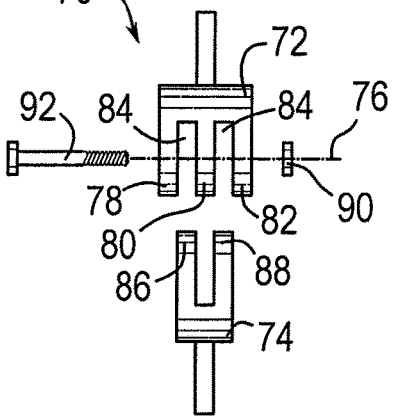
FIG. 3 is a schematic, exploded view of a resistance element in accordance with the present invention.

The resistance element 70 contained within each dynamic joint may comprise any of a variety of structures which are capable of imparting a constant or variable resistance throughout the angular range of motion. For example, one simple adjustable resistance joint is illustrated schematically in exploded view in FIG. 3.

Resistance element 70 comprises a first component 72 which is moveably connected to second component 74. In the illustrated embodiment, first component 72 comprises at least a first flange 78, preferably a second flange 80 and, as illustrated, a third flange 82 which extend generally parallel to each other and are spaced apart by spaces 84. The second component 74 is provided with at least one flange 86 and preferable a second flange 88. Flanges 86 and 88 are dimensioned such that they fit within the spaces 84. A transverse aperture may be provided, such that a pin 92 may be advanced therethrough to retain the first and second components 72 and 74 in pivotable relationship with each other. A control 90 may be provided, for either permanently fixing or adjustably providing a compression along the axis 76 to create resistance to relative rotation of the first component 72 with respect to the second component 74 about the axis 76. In a simple implementation of the invention, pin 72 may be provided with a threaded zone, and control 70 may be provided with a complementary thread, such that rotation of control 90 about pin 92 increases or decreases axial compression along the axis 76. The resistance element 70 may be integrated into the dynamic joint in manners that will be apparent to those of skill in the art.

Figure 4:
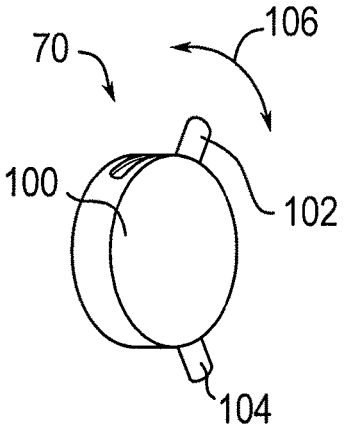
FIG. 4 is a perspective schematic view of an alternate resistance element in accordance with the present invention.

Alternatively, referring to FIG. 4, a resistance element 70 may be provided in the form of a removable housing 100. Housing 100 may comprise a first engagement structure 102 which is moveable with respect to a second engagement structure 104 throughout an angular range 106. The interior of the housing 100 may be provided with any of a variety of mechanisms, such as complementary friction surfaces, coil springs, and simple or complex gear trains. The resistance element 100 may be configured to be removably received within a corresponding cavity in the dynamic joint 54. When the resistance element 100 is disposed within the cavity, the first engagement structure 102 engages a corresponding, complementary engagement structure connected to the upper leg attachment 22, and the second engagement structure 104 engages a corresponding complementary structure connected to the lower leg attachment 24. For example, one or both of the first engagement structure 102 and second engagement structure 104 may comprise a pin, tab, aperture, or other structure which may conveniently be removably interlocked within a complementary structure carried by the exercise assembly 20.

The foregoing configuration enables the athlete to select a resistance element 70 from an array of resistance elements having graduated or otherwise dissimilar resistance characteristics. A desired resistance element may then be easily dropped into a cavity or otherwise attached to the exercise assembly 20, to provide the desired performance. When it is desired to alter the performance of the exercise assembly 20, the first resistance element 70 may be removed and a second resistance element 70, having a different resistance characteristic may be mounted instead in or on the exercise assembly 20. Different resistant elements 70 may be color coded or otherwise marked with indicium of the resistance characteristic. The dynamic joint 54 may be provided with a housing, having a cavity therein for receiving the resistance element 70, and optionally a cover, which may be snap-fit, or hingeably closed once the resistance element 70 is mounted thereon, to retain the resistance element 70 in engagement with the exercise assembly 20.

Referring to FIGS. 5 and 6, there are illustrated lateral views and posterior views, respectively, of alternate configurations of the passive exercise device 20. In general, the passive exercise device in FIG. 5 is a bilateral resistance device having a first dynamic joint 54 and a second dynamic joint (not illustrated) as disclosed in FIG. 1. Any of the resistance elements disclosed elsewhere herein may be permanently or removably integrated into the dynamic joint 54. The upper leg attachment 22 and lower leg attachment 24 are illustrated in a slightly different configuration than those illustrated in FIG. 1.

Referring to FIG. 6, there is illustrated a unilateral resistance training device. Only a single dynamic joint 54 is provided. In this embodiment, the upper leg attachment 22 and lower leg attachment 24 are both configured for rapid mounting and dismounting from the leg or other joint of the wearer. As illustrated in FIG. 6, neither the upper leg attachment 22 nor lower leg attachment 24 is provided with a connector of the type which completely encircles the adjacent limb.

Figure 7:
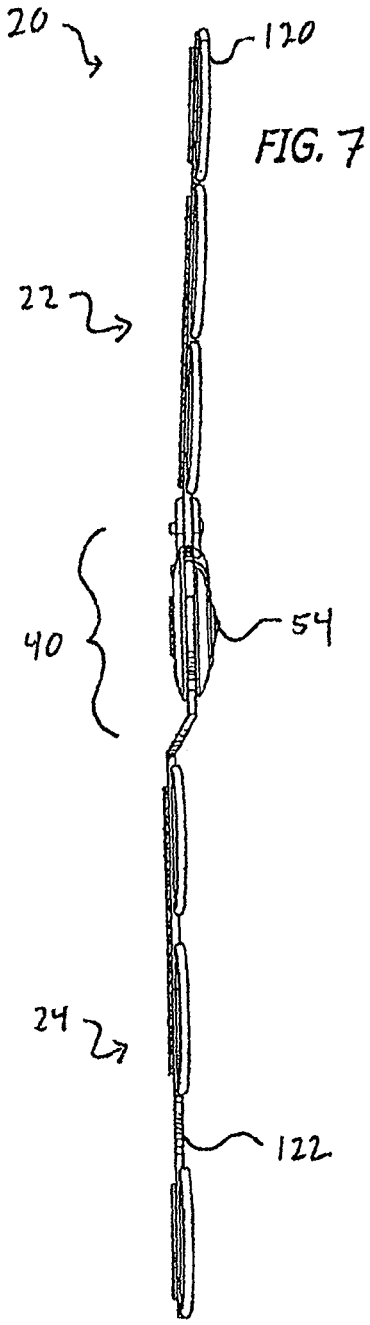
FIGS. 7 and 8 are side and plan views of an exercise insert, which may be attached to an article of clothing or other support structure in accordance with the present invention.
Figure 8:
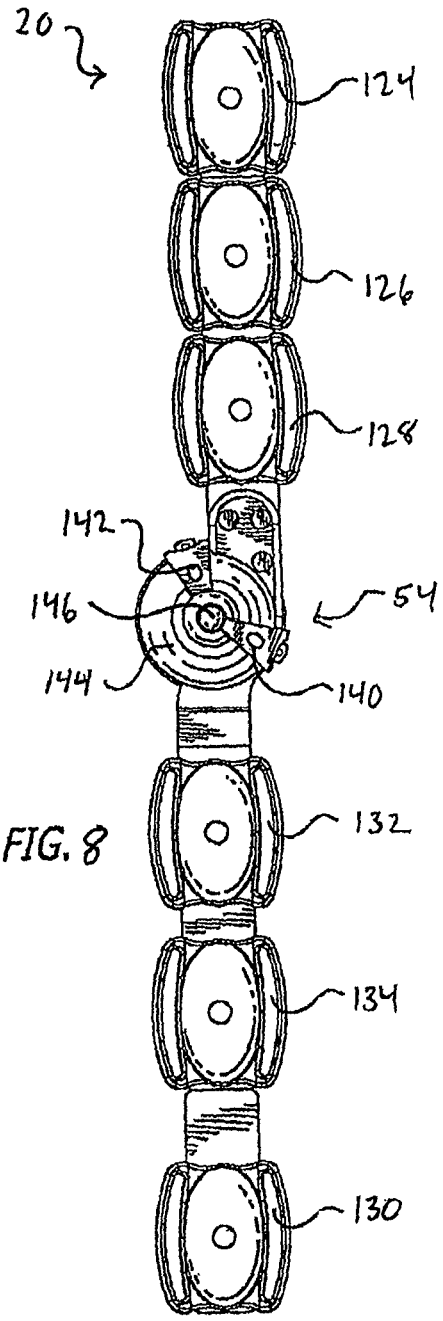

A simple passive resistance exercise device may be configured similar to that illustrated schematically in FIGS. 7 and 8. As illustrated therein, a passive exercise assembly 20 is provided with an upper leg attachment 22 and a lower leg attachment 24 which exhibit a minimal profile (thickness) so that the device 20 may be worn beneath clothing without detection. The upper leg attachment 22 comprises an elongate attachment strip 120, and the lower leg attachment 24 may comprise a lower elongate attachment strip 122. Attachment strip 120 may be provided with at least one aperture 124 for receiving a strap therethrough for surrounding the adjacent limb. A second aperture 126, and, optionally, a third aperture 128 may optionally be provided. The number of apertures and the distance of the apertures from the flex zone 40 may be selected depending upon the relative resistance intended to be provided by the exercise assembly 20.

Similarly, the lower attachment strip 122 may be provided with at least one aperture 130 optionally a second aperture 132 and further optionally a third aperture 134 for receiving additional straps, for surrounding the adjacent limb.

The flex zone 40 may be provided with a dynamic joint having any of the characteristics described elsewhere herein. In the illustrated embodiment, a first and optionally second resistance element 140 and 142 are provided in frictional engagement with a friction surface 144. As illustrated, resistance element 140 and 142 are mechanically linked to the upper attachment strip 120, while resistance surface 144 is mechanically linked to the lower attachment strip 122. The upper attachment strip 120 and lower attachment strip 122 are pivotably related to each other about an axis 146 which may be a single, fixed axis, or a compound axis to mimic certain natural joint movement.

Alternatively, the embodiment illustrated in FIGS. 7 and 8 can be integrated with an article of clothing. For example, the exercise assembly 20 may be sewed, adhesively bonded, interfit within, or otherwise connected to the pant leg of a lower garment or the sleeve of an upper garment such that when the garment is worn, the flex zone 40 is positioned in the vicinity of the joint. One or more of the exercise assemblies 20 may be provided per joint, such as one on the lateral side and one on the medial side. Attachment may be conveniently provided by stitching through the aperture 124, 130 etc. to a fabric garment.

As a further alternative, the exercise assembly 20 of FIGS. 7 and 8 may be attached to a tubular sleeve, such as a woven fabric or flexible polymeric material, having a length of less than a complete pant leg or less than a complete long sleeve of a shirt. Thus, the tubular exercise device may be pulled onto the arm or leg and positioned in the vicinity of the joint, to hold the passive exercise device 20 in position across the joint. In this manner, the passive exercise device may be readily pulled on or off of the wearer, and then covered by conventional clothing if desired.

In any of the foregoing embodiments, it may be desirable to provide a release which disengages the resistance to movement upon an abrupt increase in force from the wearer. The release may be in the form of a releasable detent or interference joint which can be opened by elastic deformation under force above a preset threshold which is set above normally anticipated forces in normal use. If a wearer should stumble, the reflexive movement to regain balance will activate the release and eliminate resistance to further movement, as a safety feature.

Figure 9:
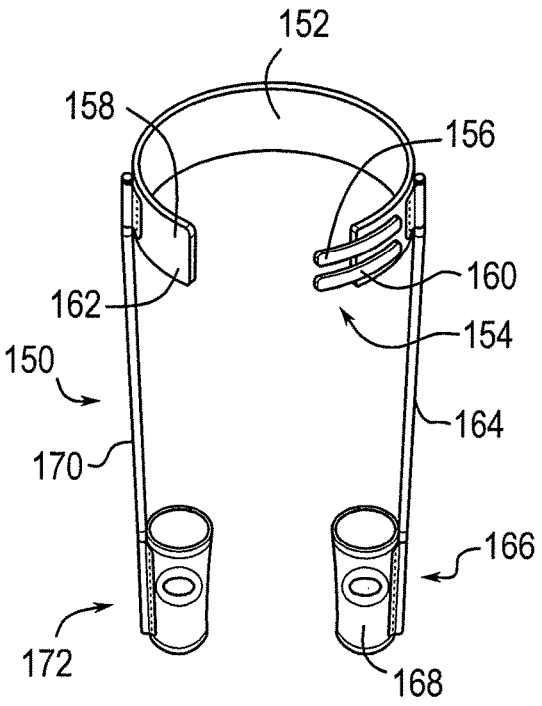
FIG. 9 is a front perspective view of an exercise device in accordance with the present invention, for providing resistance to movement at the hip.

Resistance exercise devices in accordance with the present invention may also be configured for use with larger muscle groups or more complex muscle sets, such as the exercise device illustrated in FIG. 9 which is adapted for providing resistance to movement at the hip. The exercise device 150 comprises a superior attachment structure such as a waistband 152 for encircling the waist of the wearer. Waistband 152 if provided with a closure structure 154, such as at least a first attachment structure 156 and optionally a second attachment structure 160. First attachment structure 156 and second attachment structure 160 cooperate with corresponding attachment structures 158 and 162 to enable secure closure of the waistband 152 about the waist of the wearer, in an adjustable manner. Any of a variety of closure structures such as belts, hook and loop or Velcro strips, snaps, or others disclosed elsewhere herein may be utilized.

A first (left) resistance element 164 is secured to the waistband 152 and extends across the hip to a first inferior attachment structure 166. The first inferior attachment structure 166 may comprise any of a variety of structures for securing the first resistance element 164 to the wearer's leg. As illustrated, the first inferior attachment structure 166 is in the form of a cuff 168, adapted to surround the wearer's knee. The cuff 168 may alternatively be configured to surround the wearer's leg above or below the knee, depending upon the desired performance characteristics. Cuff 168 may be provided with an axial slit for example running the full length of the medial side, so that the cuff may be advanced laterally around the wearer's leg, and then secured using any of a variety of snap fit, Velcro or other adjustable fasteners. Alternatively, the cuff 168 may comprise a stretchable fabric cuff, that may be advanced over the wearer's foot and up the wearer's leg into position at the knee or other desired location.

As will be apparent from FIG. 9, the exercise device 150, as worn, will provide resistance to movement at the hip in an amount that depends upon the construction of first resistance element 164. First resistance element 164 may comprise any of a variety of structures which provide resistance to movement, as have been described elsewhere herein. In one embodiment, first resistance element 164 comprises one or more elongate elements such as a rod or bar of homogeneous bendable material. In one embodiment, the first resistance element comprises an elongate copper rod, having a diameter within the range of from about 0.25 inches to about 0.75 inches. As the wearer advances a leg forward from a first, neutral position to a second, forward position, the rod bends to provide resistance. The malleable nature of this material causes the force to stop once the leg has reached the second, forward position. As the leg is brought rearwardly from the second, forward position, the rod again bends, providing resistance to movement in the opposite direction. This resistance may be considered passive, and the rod exerts no directional bias in the absence of motion by the wearer.

Alternatively, the first resistance element 164 may comprise a material which provides an active bias in any predetermined direction. For example, a rod or coil spring comprising a material such as spring steel, Nitinol, or a variety of others known in the art, will provide zero bias in its predetermined neutral position. However, any movement of the wearer's leg from the predetermined zero position will be opposed by a continuous bias. Thus, even when the wearer's leg is no longer in motion, the first resistance element 164 will urge the wearer's leg back to the preset zero position.

The exercise device 150 is preferably bilaterally symmetrical, having a second resistance element 170 and a second inferior attachment 172 formed essentially as a mirror image of the structure described above.

Figure 10:
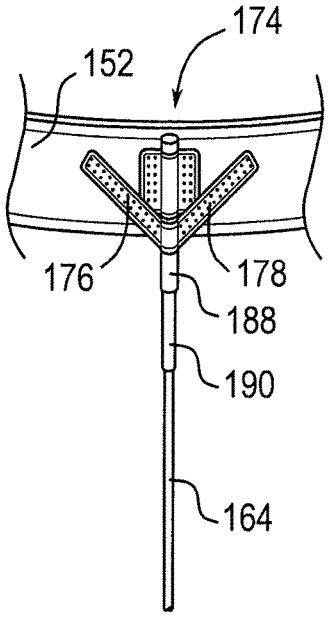
FIG. 10 is a side elevational view of an attachment structure between a waistband and resistance element of FIG. 9.
Figure 11:
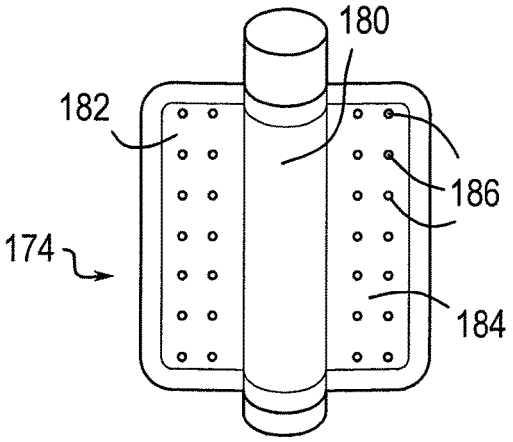
FIG. 11 is a detail view of a connector, for connecting a resistance element to a waistband.

The resistance elements may be connected to the waistband 152 in any of a variety of ways. For example, referring to FIG. 10, resistance element 164 is connected to waistband 152 by way of a connector 174 described in greater detail in FIG. 11. In addition, a first stabilizer 176 and a second stabilizer 178 may be provided, to further secure the resistance element 164 relative to waistband 152.

The connector 174 may comprise a tubular sleeve 180 for receiving the first resistance element 164. The tubular sleeve 180 is secured to a first flange 182 and a second flange 184 which may be provided with a plurality of apertures 186, for attachment to the waistband 152 such as by stitching. In addition or as an alternative, any of a variety of attachment features may be utilized, such as grommets, clips, adhesive bonding, or others known in the art. The flanges 182 and 184 may be fabric, which may or may not be reinforced such as by an internal wire frame or polymeric sheet insert or backing.

The bending characteristics of the first resistance element 164 may be optimized by providing a first tubular support 188 concentrically disposed over a second support 190 which is concentrically disposed over the first resistance element 164. This structure enables control of the flexibility characteristics and moves the bending point inferiorly along the length of the first resistance element 164.

Figure 12:
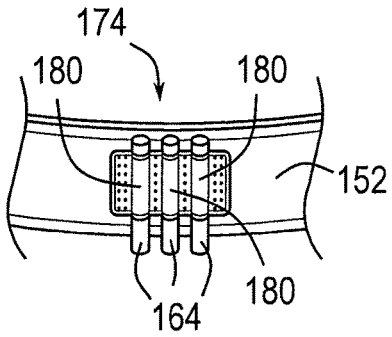
FIG. 12 is a detail view of a connector for connecting multiple resistance elements to a waistband.

The first and second resistance elements 164 and 170 can be provided in a set of graduated resistance values such as by increasing cross-sectional area, or by increase in the number of resistance elements 164. Thus, referring to FIG. 12, a connector 174 is disclosed which includes a first, second and third tubular element 180 for receiving a first, second and third resistance element 164. One or two or three or four or more resistance elements may be provided, depending upon the construction of the resistance element as will be apparent to those of skill in the art in view of the disclosure herein.

At least a right and a left safety release is preferably provided, to release the resistance from the right and left resistance elements in response to a sudden spike in force applied by the wearer such as might occur if the wearer were to try to recover from missing a step or tripping. The release may be configured in a variety of ways depending upon the underlying device design. For example, in a solid flexible rod resistance element, a short section of rod may be constructed of a different material which would snap under a sudden load spike. That resistance element would be disposed and replaced once the release has been actuated. Alternatively, a male component on a first section of the resistance element can be snap fit with a female component on a second section of the resistance element, such that the two components become reversibly disengaged from each other upon application of a sudden force above the predetermined safety threshold. Two components can be pivotable connected to each other along the length of the resistance element, but with a coefficient of static friction such that movement of the pivot is only permitted in response to loads above the predetermined threshold. Alternatively, one or more of the connectors 174 or corresponding inferior connectors can be releasably secured with respect to the wearer. Any of a variety of interference fit attachment structures or hook and loop fasteners can be optimized to reversibly release upon application of the threshold pressure. In more complex systems or systems configured for relatively high resistance such as for heavy athletic training, more sophisticated release mechanisms may be configured such as those used in conventional ski bindings and well understood in the art.

Figure 13:
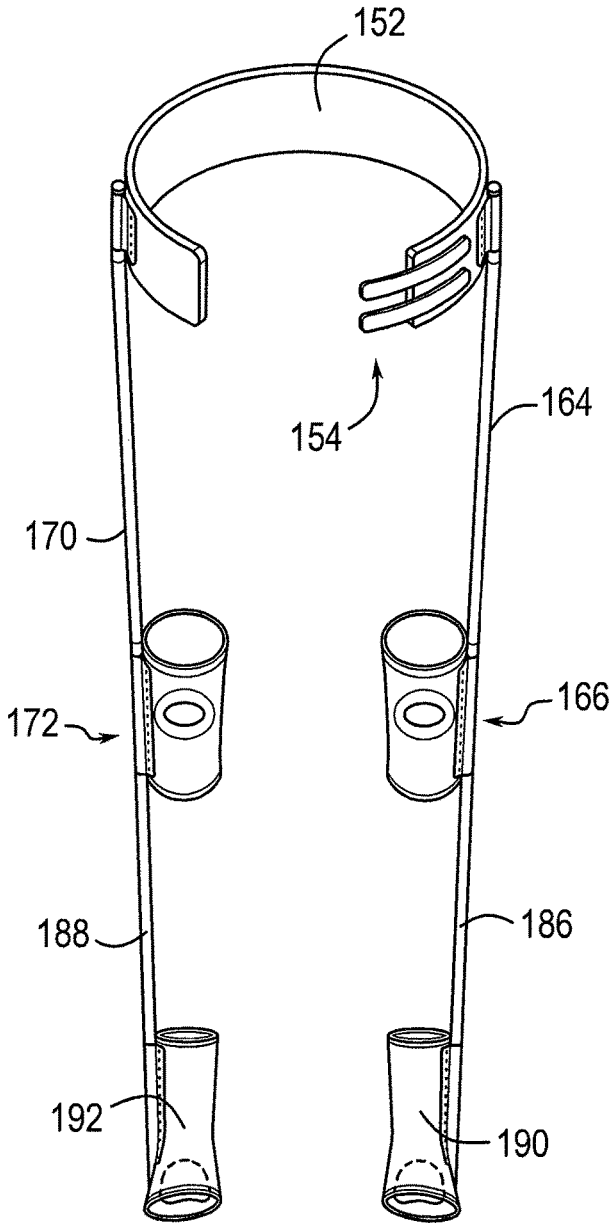
FIG. 13 is a front perspective view of an exercise device, for providing resistance to movement at both the hip and the knee.

Referring to FIG. 13, there is disclosed a further implementation of the present invention, which provides resistance to movement at both the hip as well as the knee. The embodiment of FIG. 13 is similar to that illustrated in FIG. 9, with the addition of a third resistance element 186 and a fourth resistance element 188 extending from the knee to the foot, ankle or leg below the knee. In the illustrated embodiment, the third resistance element 186 extends inferiorly to a foot or ankle support 190. The fourth resistance element 188 extends inferiorly to a second foot or ankle support 192. The foot or ankle supports 190 and 192 may comprise any of a variety of structures, such as an ankle band for surrounding the ankle, a boot or sock for wearing on the foot, and/or a shoe or other article to be attached in the vicinity of the foot.

Figure 14:
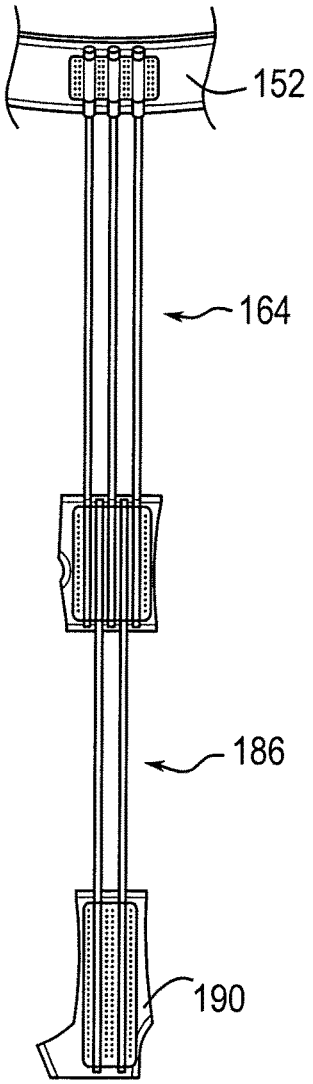
FIG. 14 is a side elevational view of the exercise device of FIG. 13, in which a greater degree of resistance is provided to movement at the hip compared to the knee.

Referring to FIG. 14, there is illustrated a side elevational view of an implementation of the design illustrated in FIG. 13. In this implementation of the invention, a first, second and third resistance elements are provided between the waistband and the knee, to provide a first level of resistance to movement. A first and second resistance elements are provided between the knee and the ankle, to provide a second, lower level of resistance between the femur and the ankle. Thus, different muscle groups may be challenged by different level of resistance as has been discussed previously herein.

Figure 16:
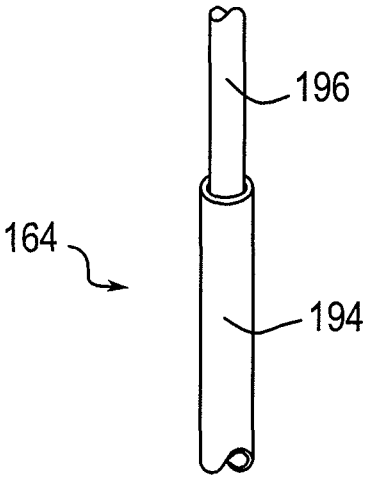
FIG. 16 is a partial elevational view of a resistance element in accordance with the present invention.

A partially exploded view of a segment of a resistance element 164 is illustrated in FIG. 16. In one implementation of the invention, the attachment structure for attaching a resistance element to the body may be one or more belts, cuffs or garments as has been described herein. The attachment structure is provided with at least one sleeve 194 extending on a generally superior inferior axis on each side of the body and optionally on the medial side (inseam) of each leg. Sleeve 194 comprises any of a variety of flexible materials, such as fabric or polymeric tubing.

Sleeve 194 removably receives a core 196. Core 196 may comprise one or more solid copper rods, or other element which resist bending. A plurality of sleeves 194 may be provided on a garment or other attachment structure, such as two or three or four or five or more, extending in parallel to each other across a joint or other motion segment to provide a multi-component resistance element. The wearer may elect to introduce a resistance core 196 into each of the sleeves 194 (e.g. for maximum resistance) or only into some of the sleeves 194 leaving other sleeves empty. In this manner, the wearer can customize the level of resistance as desired.

Figure 17:
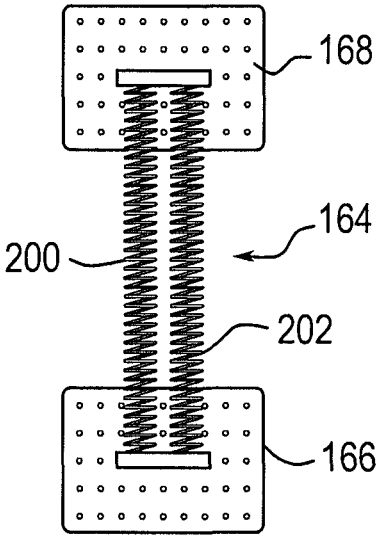
FIG. 17 is a detail view of an alternate resistance element in accordance with the present invention.

An alternative resistance element 164 is schematically illustrated in FIG. 17. Resistance element 164 comprises at least a first spring 200 extending between a superior attachment structure 168 and an inferior attachment structure 166. A second, parallel spring 202 may be provided, as well as a third or fourth or more depending upon the desired performance characteristics. Each of the first spring 200 and other springs may also be provided with a central core, such as a resistance core 196 as has been discussed. The spring system will provide bias in the direction of a preset neutral position, typically linear as illustrated in FIG. 17. In this embodiment, the resistance element 164 implemented across the knee will be neutral at a point of anatomical extension, and will resist flexion.

Figure 18:
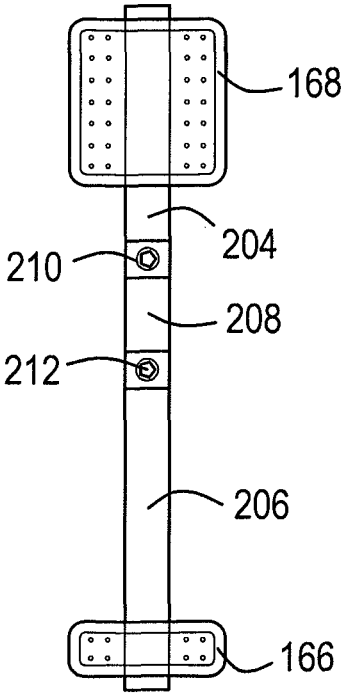
FIG. 18 is a detail view of a further resistance element in accordance with the present invention.

A further construct for resistance element 164 is schematically illustrated in FIG. 18. In FIG. 18, a superior connector 168 is connected to an inferior connector 166 by way of a segmented resistance element 164. The resistance element 164 comprises a first segment 204 and at least a second segment 206 which are pivotably connected with respect to each other across a flexion zone or pivot as has been previously discussed. In the illustrated embodiment, a third segment 208 is additionally provided. In a three segment embodiment, a first pivot 210 and a second pivot 212 are provided. The first pivot 210 and second pivot 212 impart resistance to movement, such as by two or more resistance surfaces in compression against each other. The two pivot embodiment may allow the device to conform more naturally to the compound movement of the knee as has been discussed.

Passive resistance or biased resistance to movement in accordance with the present invention may be built into a partial or full body suit, depending upon the desired performance characteristics. Resistance may be built into the body suit in any of a variety of ways, such as by incorporation of any of the foregoing structures into the body suit, and/or incorporation of elastic stretch or flex panels of different fabrics as will be disclosed below.

Figure 15:
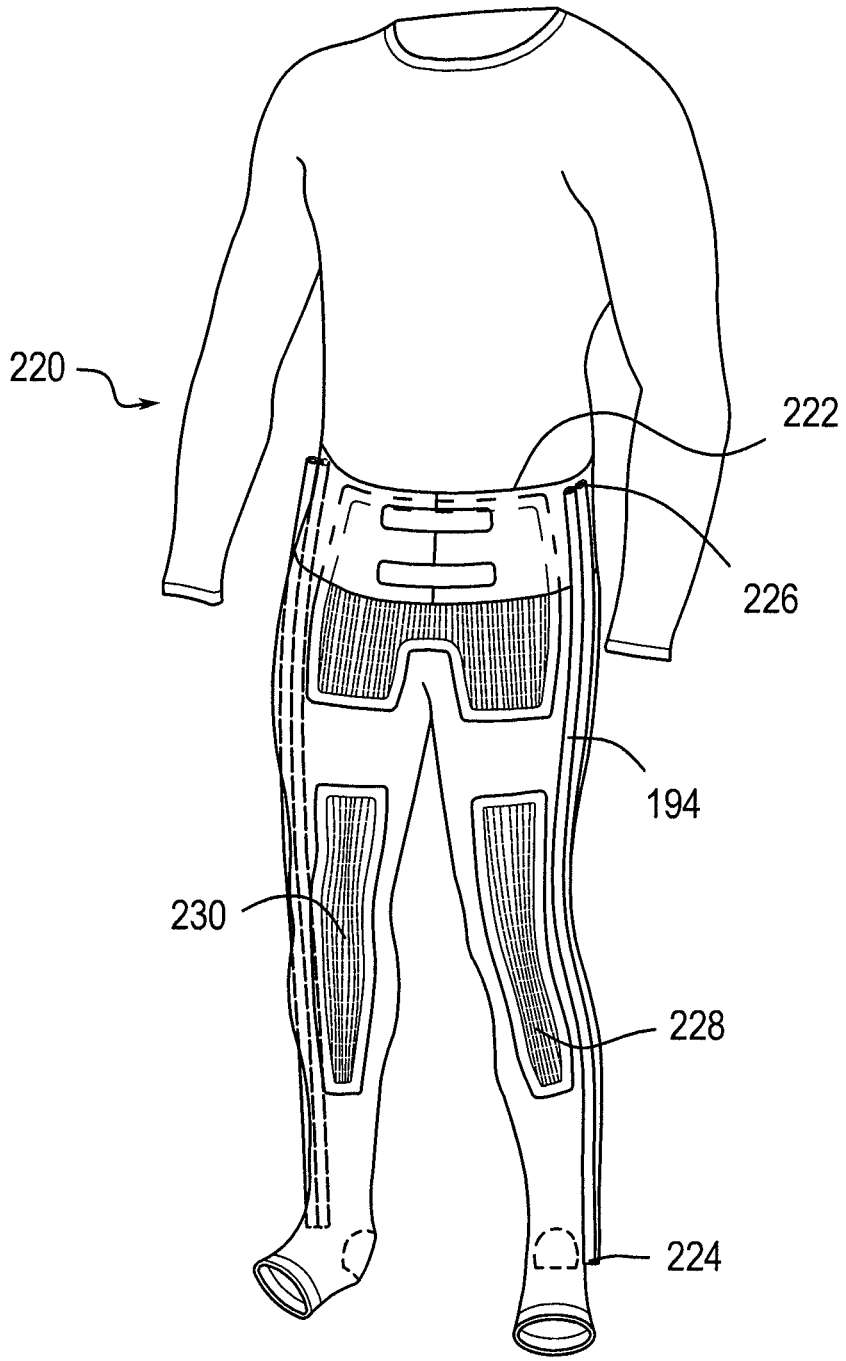
FIG. 15 is a front elevational view of a garment incorporating resistance features in accordance with the present invention.

Referring to FIG. 15, there is illustrated a front elevational view of a garment in the form of a full body suit 220, incorporating resistance elements in accordance with the present invention. Although illustrated as a full body suit, the garment may be in the form of pants alone, from the waist down, or an upper body garment similar to a shirt. In general, the body suit is provided with one or more resistance elements spanning a joint of interest, as has been discussed herein. The resistance element may be any of the devices disclosed previously herein, either removably or permanently attached to the fabric of the garment. For example, in the illustrated embodiment, a plurality of sleeves 194 extend proximally from the waist 222 down to the ankle 224 for permanently or removably receiving corresponding resistance elements therein. Preferably, the resistance elements may be removably carried by the garment, such as via an opening 226 illustrated at the superior end of sleeve 194, thereby enabling customization of the resistance level by the wearer. In addition, the resistance elements may preferably be removed for laundering the garment, and for taking the garment on and off. The garment can more easily be positioned on the body without the resistance elements, and the resistance elements may be introduced into the sleeve 194 or other receiving structure thereafter.

In addition, or as an alternative to the resistance elements disclosed previously herein, the garment may be provided with one or more elastic panels positioned and oriented to resist movement in a preselected direction. For example, an elastic panel having an axis of elongation in the inferior superior direction, and positioned behind the knee, can provide resistance to extension of the knee. Alternatively, a stretch panel on the front or anterior surface of the leg, spanning the knee, can bias the knee in the direction of extension and resist flexion. Panels 228 and 230 illustrated in FIG. 15 can be configured to stretch upon flexion of the knee thereby biasing the garment in the direction of extension. Resistance to flexion or extension or other movement of any other joint or motion segment in the body can be provided, by orienting one or more stretch panels of fabric in a similar fashion.

Any of a variety of fabrics may be utilized to form the garment, preferably materials which are highly breathable thereby allowing heat and moisture to escape, and having sufficient structural integrity to transfer force between the body and the resistance elements. The fabric can be compression or other elastic fabric, or an inelastic material with elastic panels in position to load specific muscle groups.

The term "elastic" as used throughout this detailed description and in the claims is used to describe any component that is capable of substantial elastic deformation, which results in a bias to return to its non deformed or neutral state. It should be understood that the term "elastic" includes but is not intended to be limited to a particular class of elastic materials. In some cases, one or more elastic portions can be made of an elastomeric material including, but not limited to: natural rubber, synthetic polyisoprene, butyl rubber, halogenated butyl rubbers, polybutadiene, styrene-butadiene rubber, nitrile rubber, hydrogenated nitrile rubbers, chloroprene rubber (such as polychloroprene, neoprene and bayprene), ethylene propylene rubber (EPM), ethylene propylene diene rubber (EPDM), epichlorohydrin rubber (ECO), polyacrylic rubber, silicone rubber, fluorosilicone rubber (FVMQ), fluoroelastomers (such as Viton, Tecnoflon, Fluorel, Aflas and Dai-EI), perfluoroelastomers (such as Tecnoflon PFR, Kalrez, Chemraz, Perlast), polyether block amides (PEBA), chlorosulfonated polyethylene (CSM), ethylene-vinyl acetate (EVA), various types of thermoplastic elastomers (TPE), for example Elastron, as well as any other type of material with substantial elastic properties. In other cases, an elastic portion could be made of another type of material that is capable of elastic deformation or composite weaves of elastic and inelastic fibers or threads. In one exemplary embodiment, each elastic portion may include neoprene potentially augmented by a secondary elastic component such as sheets or strips of a latex or other rubber depending upon the desired elastic force and dynamic range of stretch.

Another fabric with a high modulus of elasticity is elastane, which is known in the art of compression fabrics. The material may be a polyester/elastane fabric with moisture-wicking properties. For example, the fabric may comprise 5 oz/yd.sup.2 micro-denier polyester/elastane warp knit tricot fabric that will wick moisture from the body and include 76% 40 denier dull polyester and 24% 55 denier spandex knit. The high elastane content allows for proper stretch and support. The fabric may be a tricot construction at a 60" width. The mean warp stretch may be 187% at 10 lbs of load, and the mean width stretch may be 90% at 10 lbs of load. This fabric also may have a wicking finish applied to it. Such a fabric is available from UNDER ARMOUR™. Although the foregoing fabric is given as an example, it will be appreciated that any of a variety of other fabric or other materials known in the art may be used to construct the garment 100, including compression fabrics and non-compression fabrics. Examples of such fabrics include, but are not limited to, knit, woven and non-woven fabrics comprised of nylon, polyester, cotton, elastane, any of the materials identified above and blends thereof. Any of the foregoing can be augmented with mechanical resistance elements, such as bendable rods, springs and others disclosed herein.

What is claimed is:

1. A low profile, passive exercise garment comprising:

a waist portion;

a left leg portion;

a right leg portion;

a left hip resistance damper releasably carried by the garment such that movement of the left leg portion relative to the waist portion is resisted by the left hip damper; and a right hip resistance damper releasably carried by the garment such that movement of the right leg portion relative to the waist portion is resisted by the right hip damper, wherein the resistance dampers each impart bidirectional resistance in response to movement between the respective leg portions and the waist portion, throughout a range of motion, but impart no directional bias in the absence of motion between the respective leg portions and the waist portion.

2. A low profile, passive exercise garment as in claim 1, further comprising a left knee damper and a right knee damper.

3. A low profile, passive exercise garment as in claim 2, wherein the garment imposes a first level of resistance to movement across a hip and a second level of resistance across a knee, and the first level is greater than the second level.

4. A low profile, passive exercise garment as in claim 1, wherein the garment comprises a compression fabric.

5. A low profile, passive exercise garment as in claim 4, wherein the fabric comprises a polyester elastane fabric with moisture wicking properties.

6. A low profile, passive exercise garment as in claim 4, wherein the left and right dampers each impose a resistance of at least about 0.5 foot pounds.

7. A low profile, passive exercise garment as in claim 4, wherein the left and right dampers each impose a resistance of at least about 1 foot pound.

* * * * *